US009121177B1

(12) United States Patent
Sorkin

(10) Patent No.: US 9,121,177 B1
(45) Date of Patent: Sep. 1, 2015

(54) UPPER BEAM SLAB BOLSTER FOR USE IN CONSTRUCTION

(76) Inventor: Felix L. Sorkin, Stafford, TX (US)

( * ) Notice: Subject to any disclaimer, the term of this patent is extended or adjusted under 35 U.S.C. 154(b) by 874 days.

(21) Appl. No.: 12/535,591

(22) Filed: Aug. 4, 2009

Related U.S. Application Data

(63) Continuation-in-part of application No. 12/349,389, filed on Jan. 6, 2009, now Pat. No. 7,870,703.

(51) Int. Cl.
*E04C 5/20* (2006.01)
*E04C 5/08* (2006.01)
*E04C 5/16* (2006.01)

(52) U.S. Cl.
CPC ... *E04C 5/20* (2013.01); *E04C 5/08* (2013.01); *E04C 5/168* (2013.01)

(58) Field of Classification Search
CPC ..... E04C 5/20; E04C 5/168; E04C 5/08
USPC ..... 52/633, 677, 680, 681, 687, 689; 211/85.2, 85.3, 74, 59.2
See application file for complete search history.

(56) References Cited

U.S. PATENT DOCUMENTS 2,582,301 A * 1/1952 Walker ..... 160/174 R
3,189,081 A * 6/1965 Lorentzen et al. ..... 160/173 R
3,454,130 A * 7/1969 Pellandine ..... 182/46
3,655,162 A * 4/1972 Shoemaker ..... 249/219.2
3,784,022 A * 1/1974 Beesley, Jr. ..... 211/59.2
4,474,297 A * 10/1984 Zucker ..... 211/59.2
D329,556 S * 9/1992 Brussing ..... D6/468
5,156,234 A * 10/1992 McCallum et al. ..... 182/46
D363,174 S * 10/1995 Fletcher, Sr. ..... D6/408
5,664,390 A 9/1997 Sorkin
5,664,613 A * 9/1997 Jelic ..... 160/84.05
5,806,579 A * 9/1998 Judkins ..... 160/168.1 R
6,186,345 B1 * 2/2001 Robertson ..... 211/59.2
D445,668 S * 7/2001 Hills, Sr. ..... D8/354
6,536,172 B1 * 3/2003 Amend ..... 52/426
6,712,022 B2 * 3/2004 Fullerton, III ..... 119/201
6,772,571 B1 8/2004 Sorkin
6,772,815 B1 * 8/2004 Judkins ..... 160/84.05
6,775,954 B1 8/2004 Sorkin
6,948,291 B2 * 9/2005 Haslem et al. ..... 52/677
7,108,453 B2 * 9/2006 Harris ..... 404/135
7,234,254 B2 * 6/2007 Schmidt ..... 40/310
7,284,354 B1 10/2007 Sorkin
7,373,764 B1 5/2008 Sorkin (Continued)

FOREIGN PATENT DOCUMENTS

WO WO 93/02271 * 2/1993 ..... E06C 1/12

OTHER PUBLICATIONS

U.S. Appl. No. 12/349,389, filed Jan. 6, 2009, Sorkin, Felix L.

*Primary Examiner* — Joshua J Michener
*Assistant Examiner* — Alp Akbasli
(74) *Attorney, Agent, or Firm* — Egbert Law Offices, PLLC

(57) ABSTRACT

A bolster for use in construction has a pair of spaced apart frame members and a plurality of rung members in spaced relationship extending between the pair of spaced apart frame members. The pair of spaced apart frame members have a generally rectangular configuration and a plurality of openings formed therethrough. The pair of spaced apart frame members and the plurality of rung members are formed integrally together of a polymeric material. The openings of the pair of spaced apart frame members have a generally rectangular shape.

10 Claims, 3 Drawing Sheets

(56) References Cited

U.S. PATENT DOCUMENTS

| | | | | |
|---|---|---|---|---|
| D571,189 | S * | 6/2008 | Verelli et al. | D8/354 |
| 7,497,059 | B2 * | 3/2009 | Bennett | 52/677 |
| D609,373 | S * | 2/2010 | Curtas | D25/199 |
| 7,681,743 | B2 * | 3/2010 | Hanretty et al. | 211/59.2 |
| 2003/0122333 | A1 * | 7/2003 | Abraham | 280/79.7 |
| 2003/0173038 | A1 * | 9/2003 | Robinson | 160/178.3 |
| 2004/0107668 | A1 * | 6/2004 | Haslem et al. | 52/677 |
| 2004/0111814 | A1 * | 6/2004 | Allen | 14/69.5 |
| 2004/0151404 | A1 * | 8/2004 | Richardson et al. | 383/16 |
| 2007/0108145 | A1 * | 5/2007 | Milardo et al. | 211/74 |
| 2009/0165420 | A1 * | 7/2009 | Pfeffer et al. | 52/677 |

* cited by examiner

UPPER BEAM SLAB BOLSTER FOR USE IN CONSTRUCTION

CROSS-REFERENCE TO RELATED U.S. APPLICATIONS

The present application is a continuation-in-part of U.S. application Ser. No. 12/349,389, filed on 6 Jan. 2009, entitled "UPPER BEAM SLAB BOLSTER FOR USE IN CONSTRUCTION," presently pending.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to bolsters that are used in construction activities for the support of post-tension cables, rebars or mesh. More particularly, the present invention relates to upper beam bolsters that are designed for support on underlying layers of mesh and rebar or on slab-on-grade surfaces. Additionally, the present invention relates to upper beam bolsters formed integrally together of a polymeric material.

2. Description of Related Art Including Information Disclosed Under 37 CFR 1.97 and 37 CFR 1.98

Bolsters are commonly used in the construction industry for the support of post-tension cables, rebars, or mesh above a surface. Typically, when such materials are used, they must be supported above the surface when the concrete is poured. These bolsters are used with poured decks. In normal use, the bolster is positioned on the deck and includes a beam which extends across a plurality of leg members. This beam is formed so as to contact and support the rebar while the base of the bolster rests on the deck or on a grade. When the concrete is poured, the bolster will support the rebar a proper distance above the bottom surface.

In normal use, such bolsters are preformed so that they can be installed quickly and easily upon the deck. Conventionally, the preformed bolster will have a plurality of leg members and a steel rod welded to a top surface of each of the leg members. The rod will serve as a receiving area for the rebar. Conventionally, these bolsters are formed in preset lengths. If it is necessary to extend the bolster across a long surface of the deck, then the ends of the beams of adjacent bolsters will be wired together such that the bolsters are in an end-to-end relationship.

The most common bolster that is employed is a metal bolster manufactured by Meadow Steel Products of Tampa, Fla. This bolster has a plurality of inverted U-shaped leg members having outwardly extending foot portions. A rigid tubular rod having a slight waveform pattern formed thereon is welded to the middle of the inverted U-shaped leg members. Each of the leg members is generally arranged in parallel relationship to each other. The feet of each of the leg members will rest on the deck while the rebar is supported. After the concrete has solidified, and the deck is removed, the bottom surfaces of the feet will be exposed. As such, it is necessary to coat the feet with an anti-rust material. Alternatively, stainless steel material can be employed for the leg members and their associated feet.

Corrosion and cost are major problems affecting the bolster of Meadow Steel Products. In order to form such a bolster, a great deal of manufacturing must take place, including metal forming, bending, dipping, and welding. These activities, along with the cost of the material used to form the bolster, make the cost of the bolster relatively expensive. If the bolster is not coated or made of a stainless steel material, then corrosion can adversely affect the product. This corrosion can even occur when the metal is coated.

In the past, various attempts have been made to create bolsters of plastic material that can serve the purposes of the bolster of Meadow Steel Products. In general, such efforts have resulted in plastic chairs that are ineffective, cumbersome to use, or unable to properly withstand the forces imparted by the rebar upon the bolster. One such plastic bolster, manufactured by Conac, includes a central beam which is integrally formed with a plurality of leg members. Each of the leg members extends downwardly so as to present a flat surface to the underlying deck. No feet are provided which allow the bolster to be stapled to the deck. Additionally, the configuration of this Conac bolster allows for easy deformation. It is very difficult and time consuming to join lengths of the Conac bolster together. This plastic bolster is often broken, collapsed, or tipped over in actual use. The base of such a bolster has only a very small area of contact with the deck. As such, these plastic bolsters lack the strength and ability to withstand the loads imparted to them.

U.S. Pat. No. 5,664,390, issued on Sep. 9, 1997 to the present inventor, describes a bolster for use in construction. This bolster has a plurality of leg members arranged in parallel relationship and a beam integrally formed with the plurality of leg members and extending across the plurality of leg members. Each of the plurality of leg members has a foot for contacting the underlying surface. Each of the leg members includes a central body portion, a first leg extending downwardly from one side of the central body portion and a second leg extending downwardly from an opposite side of the central body portion. The foot is formed at an end of each of the first and second legs opposite the central body portion. The foot includes a plurality of pin-like projections extending outwardly from a bottom surface thereof. This bolster is of a type for stapling and fixed attachment to an underlying deck. However, under certain circumstances, it would be desirable to be able to use these bolsters for "upper beam" purposes. Upper beam bolsters are often used upon the top of mesh or layers of strands. The upper beam bolsters are commonly used in highway construction where multiple layers of steel are laid out. Under other circumstances, a widened or flat base is required for slab-on-grade construction. The relatively small and narrow feet would sink into sand or dirt if the bolsters of U.S. Pat. No. 5,664,390 were used for "upper beam" purposes. In other circumstances, upper beam slab bolsters are used on corrugating steel decking so as to be in flat surface-to-surface contact with such steel flat surfaces. As such, a need developed so as to allow the bolster of U.S. Pat. No. 5,664,390 to be properly adapted for upper beam bolster purposes.

U.S. Pat. No. 6,775,954, issued on Aug. 17, 2004 to the present inventor, describes such a bolster properly adapted for upper beam bolster purposes. The bolster has a plurality of leg members arranged in generally parallel spaced relationship to each other, a beam integrally formed with the plurality of leg members and extending transversely across the leg members, a first plate affixed to one side of the plurality of leg members and a second plate affixed to an opposite side of the plurality of leg members. Each of the plates has a generally flat bottom surface. A clip is provided on the plates for fixedly attaching the plates to respective feet of the leg members. While the article associated with U.S. Pat. No. 6,775,954 proved successful, connecting the plates with the feet of the leg members is a labor-intensive process. As such, a need has developed for an upper beam slab bolster which does not require assembly.

U.S. Pat. No. 6,772,571, issued on Aug. 10, 2004 to the present inventor, teaches a bolster for use in construction that has a plurality of leg members arranged in a generally parallel spaced relationship, a beam integrally formed with the plurality of leg members which extends transversely across the plurality of leg members, and a plate affixed to the bottom of the plurality of leg members. The plate has a generally flat bottom surface. The plate has at least one clip formed on the top surface receiving a foot associated with at least one of the leg members.

U.S. Pat. No. 7,284,354, issued on Oct. 23, 2007 to the present inventor, describes a bolster for use in construction. The bolster has a beam, a first plurality of leg members on one side of the beam, a second plurality of leg members on an opposite side of the beam, a first plate having a receptacle on one side thereof and a second plate having a receptacle on one side. The receptacle of the first plate receives a portion of the first plurality of leg members therein. The receptacle of the second plate receives a portion of the second plurality of leg members. The receptacles have a generally C-shaped cross section for resiliently contacting surfaces of the respective leg members. The plate is integrally formed of an extruded polymeric material.

U.S. Pat. No. 7,373,764, issued on May 20, 2008 to the present inventor teaches a similar extruded upper beam slab bolster for use in construction. The bolster has a beam, a first plurality of leg members on one side of the beam, a second plurality of leg members on an opposite side of the beam, and a plate having a first receptacle on one side and a second receptacle on the opposite side. The first receptacle receives a portion of the first plurality of leg members therein. The second receptacle receives a portion of the second plurality of leg members therein. The plate is integrally formed of an extruded polymeric material.

U.S. patent application Ser. No. 12/349,389, filed on Jan. 6, 2009 by the present inventor describes an extruded upper beam slab bolster that has a snap-fit arrangement between segments of the bolster. The bolster has a beam, a pair of spaced apart foot members, a first plurality of leg members on one side of the beam, and a second plurality of leg members on an opposite side of the beam. The first plurality of leg members are connected at one end to the beam and at the opposite end to one of the pair of spaced apart foot members. The second plurality of leg members are connected at one end to the beam and at the opposite end to the other of the pair of spaced apart foot members. The beam, pair of spaced apart foot members and first and second pluralities of leg members are integrally formed together of a polymeric material. Multiple lengths of bolster may be joined together in a snap-fit engagement.

It is an object of the present invention to provide an upper beam slab bolster that is corrosion-proof and relatively inexpensive.

It is another object of the present invention to provide an upper beam bolster that can withstand the forces imparted to it.

It is a further object of the present invention to provide an upper beam slab bolster that is integrally formed together through injection molding processes.

It is still a further object of the present invention to provide an upper beam bolster that is easy to manufacture and easy to use.

These and other objects and advantages of the present invention will become apparent from a reading of the attached specification and appended claims.

BRIEF SUMMARY OF THE INVENTION

The present invention is a bolster for use in construction having a pair of spaced apart frame members and a plurality of openings formed therethrough, and a plurality of rung members in spaced relationship extending between the pair of spaced apart frame members. The pair of spaced apart frame members and the plurality of rung members are integrally formed together of a polymeric material. The plurality of rung members may have a rectangular prism shape. The plurality of rung members may be positioned centrally between the top surface and the bottom surface of the pair of spaced apart frame members.

In the preferred embodiment of the present invention, the openings of frame members have a generally rectangular shape. The plurality of openings formed through the first pair of spaced apart frame members are aligned with the plurality of openings formed through the second pair of spaced apart frame members. One of the plurality of rung members is positioned between each of the plurality of openings of the pair of spaced apart frame members.

In an alternative embodiment of the present invention, the openings have a generally triangular shape. The openings having vertices and the openings alternate between a triangular opening facing upwardly and a triangular opening facing downwardly such that each vertex of a triangular opening is adjacent two vertices of two other triangular openings. One of the plurality of rung members is positioned at each point where the vertices of the triangular openings meet.

DETAILED DESCRIPTION OF THE INVENTION

Figure 1:
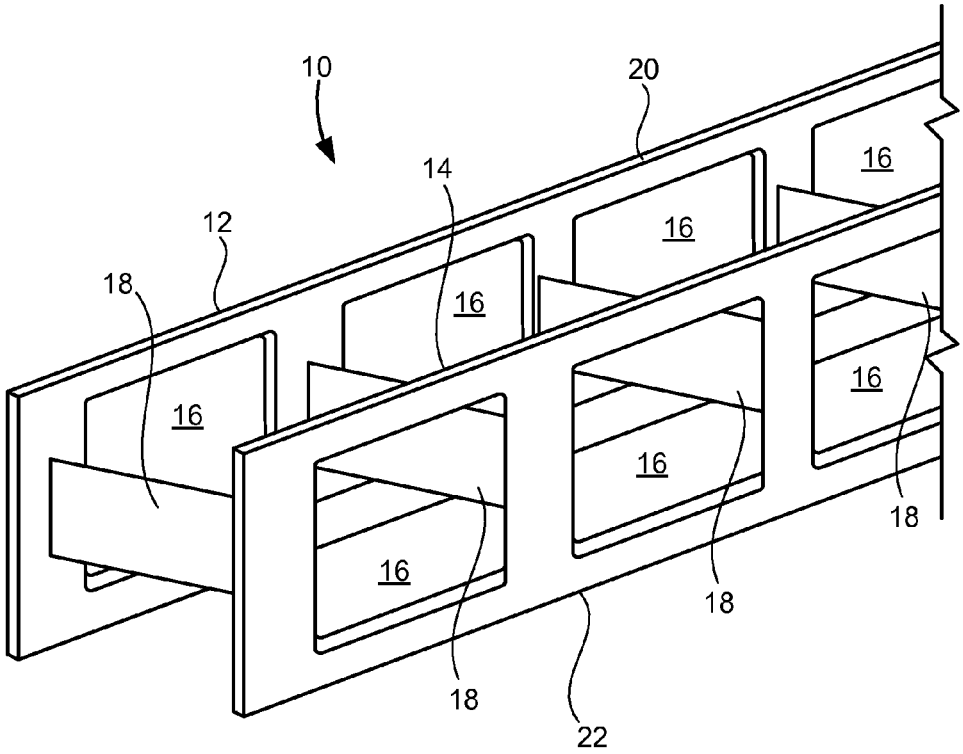
FIG. 1 is a perspective view of the preferred embodiment of the upper beam slab bolster of the present invention.

Referring to FIG. 1, there is shown a perspective view of the preferred embodiment of the upper beam slab bolster 10 of the present invention. The slab bolster 10 has a pair of spaced apart frame members. The pair includes first frame member 12 and second frame member 14. A plurality of rung members 18 extend between the first frame member 12 and the second frame member 14.

Each of the first frame member 12 and the second frame member 14 have a plurality of openings 16 formed therethrough. The plurality of openings 16 on the first frame member 12 is aligned with the plurality of openings 16 of the second frame member 14. As shown in FIG. 1, the plurality of openings 16 has a generally rectangular shape. The plurality of rung members 18 extend between the first frame member 12 and the second frame member 14 between each of the plurality of openings 16. The rung members 18 have a generally rectangular prism shape, and are positioned between a top surface 20 and a bottom surface 22 of the first frame member 12 and the second frame member 14. Alternatively, the rung members 18 can be positioned near the top surface 20 or near the bottom surface 22.

The frame and rung structure of the bolster 10 of the present invention is very sturdy, and can hold the weight of rebar or mesh to be placed on the top surface 20. When rebar is placed on the top surface 20, often workers will walk across the rebar or mesh, adding to the weight that must be held by the bolster 10. This specific configuration is designed to hold such a greater weight. The bolster 10 of the present invention is extruded and formed integrally of a polymeric material. Being formed integrally, the present invention has advantages over prior art bolsters where assembly in the field is required. Such assembly adds significantly to the labor costs associated with installing bolsters. The use of the bolster 10 of the present invention will lead to decreased labor costs and decreased project costs.

Figure 2:
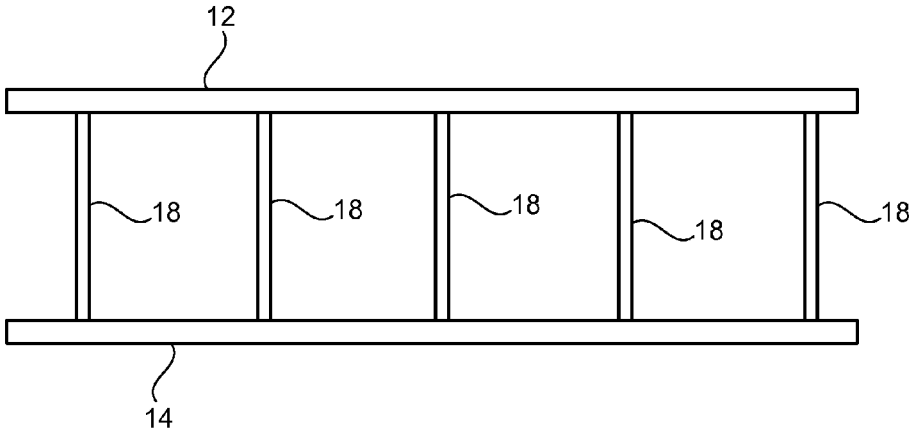
FIG. 2 is a top view of the preferred embodiment of the upper beam slab bolster of the present invention.

Referring to FIG. 2, there is shown a top view of the upper beam slab bolster 10 of the present invention. In FIG. 2 it can be seen how the rung members 18 extend between the first frame member 12 and the second frame member 14. Such a configuration has a ladder-like appearance.

Figure 3:
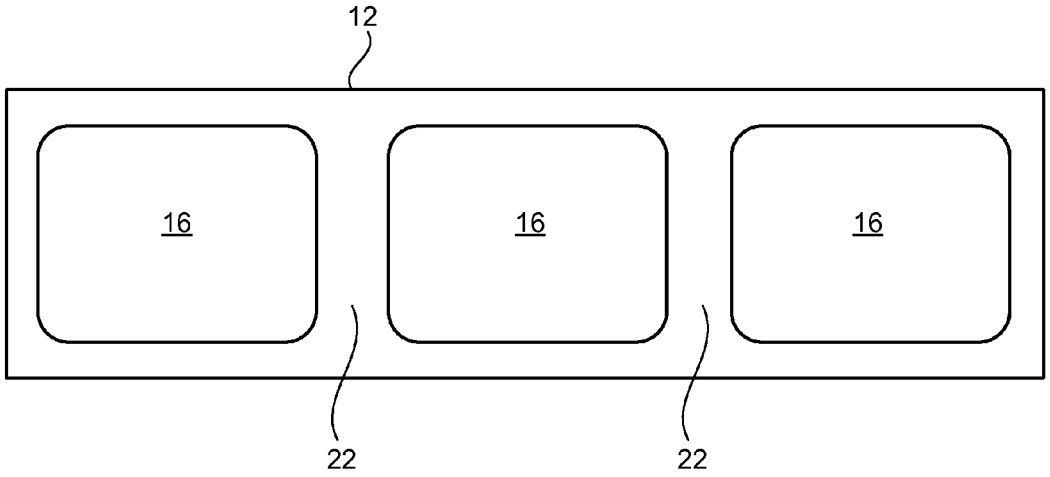
FIG. 3 is a side view of the preferred embodiment of the upper beam slab bolster of the present invention.

Referring to FIG. 3, there is shown a side view of the upper beam slab bolster 10 of the present invention. In FIG. 3, it can be seen how the generally rectangular openings 16 extend through the first frame member 12. The second frame member 14, not shown, is identical to the first frame member 12. The rung members 18 extend between the two frame members 12 and 14 at points labeled 22. While there are only three rectangular openings shown, the bolster of the present invention can include many more openings 16, depending on the application. While the openings 16 are shown to be rectangular, various other shapes of openings are contemplated including the alternative embodiment described below. However, use of the rectangular openings allows for great stability and reduced materials costs associated with the manufacture of the upper beam slob bolster 10 of the present invention.

Figure 4:
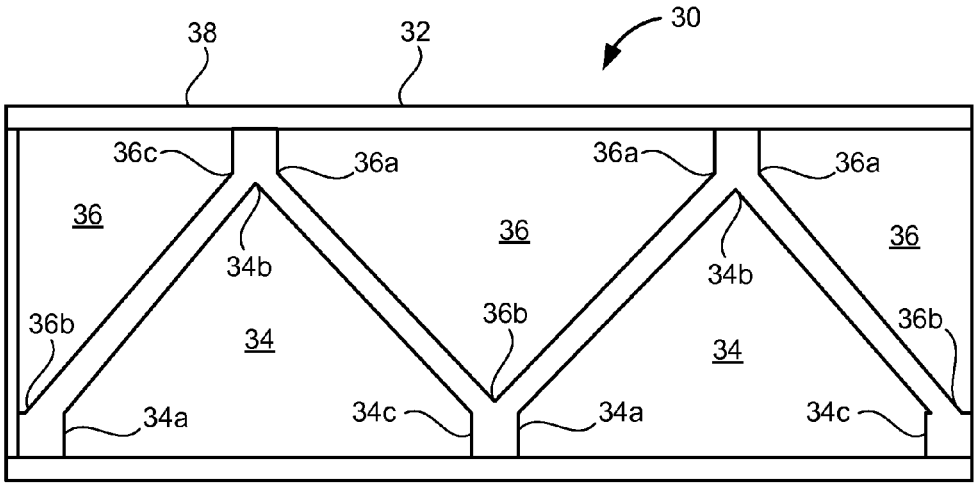
FIG. 4 is a side view of an alternative embodiment of the upper beam slab bolster of the present invention.

Referring to FIG. 4, there is shown a side view of an alternative embodiment of the present invention. The upper beam slob bolster 30 of the alternative embodiment of the present invention similarly includes first frame member 32 and an identical second frame member 38. In the alternative embodiment of the present invention, the openings through the frame members 32 and 38 have a generally triangular configuration. Shown in FIG. 4 are triangular openings 34 and 36. Triangular openings 34 include upwardly facing triangular openings and openings 36 are downwardly facing triangular openings. Along the length of the upper beam slob bolster 30 of the alternative embodiment of the present invention, the openings alternate between an upwardly facing triangular opening 34 and a downwardly facing triangular opening 36.

The triangular openings 34 and 36 each have three vertices. Because the triangular openings 34 and 36 are not true triangles, in the context of this application vertices should include each corner of the opening and not be limited to the geometrical definition of vertices or vertex. The upwardly facing triangular openings 34 have first vertices 34*a*, second vertices 34*b* and third vertices 34*c*. The downwardly facing triangular openings 36 have first vertices 36*a*, second vertices 36*b* and third vertices 36*c*. Because the openings alternate between an upwardly facing triangular opening 34 and a downwardly facing triangular opening 36, each vertex of each triangular opening is adjacent two other vertices of two other triangular openings. For example, vertex 34*b* is adjacent the vertex 36*c* of a first downwardly triangular opening 36 and vertex 36*a* of a second downwardly triangular opening 36. Rung members, not shown in FIG. 4, extend between the first frame member 32 and the second frame member 38 at each point where the vertices of the various triangular openings meet. The use of triangular openings 34 and 36 also leads to lower material costs and greater strength.

Figure 5:
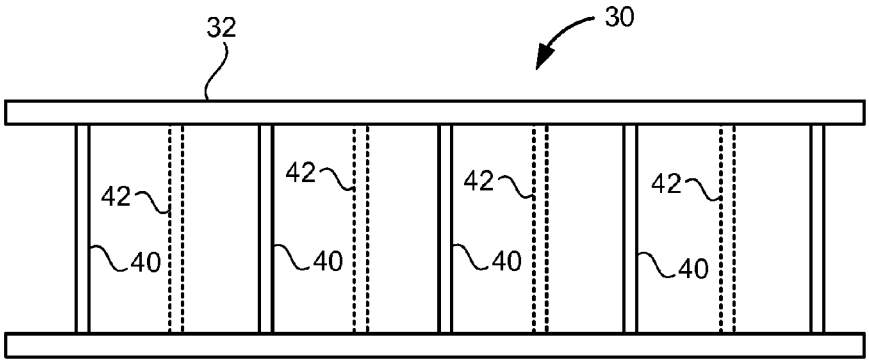
FIG. 5 is a top view of an alternative embodiment of the upper beam slab bolster of the present invention.

Referring to FIG. 5, there is shown a top view of the alternative embodiment of the present invention. Shown in FIG. 5 are the first frame member 32 and the second frame member 38 of the upper beam slob bolster 30 of the alternative embodiment of the present invention. First rung members 40 and second rung members 42 are shown extending between the first frame member 32 and the second frame member 38. The first rung members 40 extend between the first frame member 32 and the second frame member 38 at a position where the vertices of the various triangles meet adjacent the top surface of the bolster 30. The second rung members 42, shown in dashed lines, extend between the first frame member 32 and the second frame member 38 at a position where the various vertices meet near the bottom surface of the bolster 30. The rung members 40 and 42 may also have a rectangular prism shape, although they may be smaller in size that rungs shown in the preferred embodiment 10.

The foregoing disclosure and description of the invention is illustrative and explanatory thereof. Various changes in the details of the illustrated construction can be made within the scope of the present claims without departing from the true spirit of the invention. The present invention should only be limited by the following claims and their legal equivalents.

I claim:

1. A bolster for use in constructions comprising:

a pair of spaced-apart frame members having a generally rectangular configuration, each of said pair of spaced-apart frame members having a plurality of openings formed therethrough, said plurality of openings being of a volume substantially more than one-half of a total volume of the frame member; and a plurality of rung members in spaced relationship to each other, said plurality of rung members extending between said pair of spaced-apart frame members, each of said plurality of rung members being solid with no openings therein, each of said plurality of rung members having a planar shape, said pair of spaced-apart frame members and said plurality of rung members being integrally formed together of a polymeric material.

2. The bolster of claim 1, each of said each of plurality of rung members having a rectangular prism shape.

3. The bolster of claim 1, said plurality of rung members being positioned centrally between top surface and a bottom surface of said pair of spaced-apart frame members.

4. The bolster of claim 1, said openings of said frame members having a generally rectangular shape.

5. The bolster of claim 1, said plurality of openings formed through a first of said pair of spaced-apart frame members being aligned with said plurality of openings formed through a second of said pair of spaced-apart frame members.

6. The bolster of claim 5, one of said plurality of rung members being positioned between adjacent openings of said plurality of openings of said pair of spaced-apart frame members.

7. A bolster for use in construction comprising:

a pair of spaced-apart frame members having a generally rectangular configuration and a plurality of openings formed therethrough, said plurality of openings being of a volume substantially more than one-half of a total volume of the frame member, said plurality of openings each having a generally rectangular shape; and a plurality of rung members in spaced relationship extending between said pair of spaced-apart frame members, each of said plurality of rung members respectively positioned between adjacent pairs of said plurality of openings, each of said plurality of rung members having a planar shape, said pair of spaced-apart frame members and said plurality of rung members being integrally formed together of a polymeric material.

8. The bolster of claim 7, said plurality of rung members having a rectangular prism shape.

9. The bolster of claim 7, said plurality of rung members being positioned centrally between top surface and a bottom surface of said pair of spaced apart frame members.

10. The bolster of claim 7, said plurality of openings formed through the first of said pair of spaced apart frame members being aligned with said plurality of openings formed through the second of said pair of spaced apart frame members.

* * * * *